US008511531B2

(12) United States Patent
Popowich

(10) Patent No.: US 8,511,531 B2
(45) Date of Patent: Aug. 20, 2013

(54) FASTENING DEVICE

(75) Inventor: David J. Popowich, Brampton (CA)

(73) Assignee: LMN Solutions, Inc., Brampton, Ontario (CA)

( * ) Notice: Subject to any disclaimer, the term of this patent is extended or adjusted under 35 U.S.C. 154(b) by 0 days.

(21) Appl. No.: 13/353,858

(22) Filed: Jan. 19, 2012

(65) Prior Publication Data

US 2012/0111917 A1 May 10, 2012

Related U.S. Application Data

(63) Continuation of application No. 11/803,911, filed on May 16, 2007, now Pat. No. 8,118,205.

(60) Provisional application No. 60/800,735, filed on May 16, 2006.

(51) Int. Cl.
*B25C 5/06* (2006.01)

(52) U.S. Cl.
USPC ..... 227/132; 227/120; 227/125; 227/126; 173/1

(58) Field of Classification Search
USPC ..... 227/132, 120, 125, 126; 173/1
See application file for complete search history.

(56) References Cited

U.S. PATENT DOCUMENTS 3,753,524 A * 8/1973 Heyward ..... 227/132
6,789,719 B2 * 9/2004 Shor ..... 227/132

* cited by examiner

*Primary Examiner* — Michelle Lopez
(74) *Attorney, Agent, or Firm* — McDonnell Boehnen Hulbert & Berghoff LLP

(57) ABSTRACT

In accordance with an embodiment of the present invention, a fastening device such as, for example, a forward acting stapler, is provided that includes a manually operable latch in order to store the built up potential energy that results from depressing the handle of the fastening device. Upon actuation of the latch, the plunger within the fastening device is released, thereby converting the stored energy of an internal compression spring into kinetic energy and ejecting a fastener (such as, for example, staples, nails or other types of fasteners) from the staple chamber to fasten an object.

22 Claims, 19 Drawing Sheets

FASTENING DEVICE

CROSS REFERENCE TO RELATED APPLICATIONS

This application is a continuation of U.S. application Ser. No. 11/803,911, filed on May 16, 2007, now U.S. Pat. No. 8,118,205, which claims the benefit of U.S. provisional application No. 60/800,735, filed May 16, 2006, the contents of which are hereby incorporated by reference herein in their entirety.

FIELD

The present invention relates to the field of fastening tools of the type employed to drive fasteners (such as, for example, staples, nails or other types of fasteners) into various work surfaces.

BACKGROUND

Fastening tools, such as, for example, manually operated staple guns, allow an operator of the device to use a single hand in order to operate a handle or the like. Movement of the handle causes the compression of a spring in the tool. When the energy in the spring is released, a fastener is expelled from the fastening device. The operation of the handle to compress the spring and the subsequent release of the energy built up in the spring typically results from one motion of the handle. One type of fastening tool is a forward acting stapler, which is commonly known in the art, and has a handle which is pivoted at one end, the rear end, of the fastening device body. Another type of fastening tool is a rearward acting stapler, also commonly known in the art.

One example of a commonly known rearward acting stapler is disclosed in U.S. Pat. No. 2,671,215 issued to Abrams, which discloses a staple gun manufactured by Arrow. A handle is pivoted at or near the front of the staple gun. Pressing down on the handle behind the pivot at the free end of the handle compresses a coil spring within the tool. The motion of the handle rotates a pivotally attached lever arm, which in turn raises a plunger assembly including a plunger. At a pre-determined point of travel of the handle, the lever arm arcs sufficiently such that it releases the plunger assembly. The plunger is driven downwards by the force provided by the decompression of the coil spring.

With the advent of forward acting staplers, such as one disclosed is U.S. Pat. No. 5,699,949 issued to Marks, the handle is attached and pivoted at the rear of the stapler. In this configuration, it may be easier for the user to apply a load to the handle, because the load applied to the handle is more in line with the plunger. This may result in a more efficient transfer of energy through to the staple, and therefore, an improved fastening mechanism. However, the input load required to depress the handle is identical to, or substantially the same as, rearward acting staplers and is therefore still substantial.

There are certain drawbacks to conventional forward and rearward acting staplers. For example, the act of depressing the handle (and thus "loading" the device) and the act of ejection of a fastener occur as one event that happens virtually simultaneously. Oftentimes it may be difficult to apply sufficient force to the handle if one is outstretched or in some other awkward stance, or if one is trying to fasten onto a backing that is not rigidly supported. Thus, it may be desirable to have a fastening device wherein the handle can be depressed (thus putting the device in a "loaded" state) in one event, and ejection of the fastener can be occur as a separate event.

Electronic staple devices do not require manual generation of energy stored in a compression spring. Electronic staple devices, however, suffer the disadvantage of, among other things, requiring a power source and the commensurate weight penalty which comes with the ancillary mechanisms required for proper and safe operation.

Forward acting manual staple guns are well known in the art. These conventional staple guns, however, do not allow a user to store the energy within the staple gun in one step and then release the stored energy in an independent step. The provision of a mechanism for independently releasing the stored energy may be advantageous to a user of a staple gun in many instances. For example, if the user of a staple gun is required to apply a fastening device or staple above the user's head or just out of the user's reach, the user would not be able to use traditional manual staple guns to apply the fastening device with much success. This is because conventional staple guns eject the staple virtually simultaneously with the application of a considerable force applied by the user to the operating handle, i.e., squeezing the handle.

It would be therefore advantageous to develop an improved fastening device that overcomes the disadvantages described above. In particular, it may be advantageous to provide an improved fastening device wherein depressing the handle of a device to generate energy within the fastening device is one event, and the actual ejection of the fastener (e.g., staples, nails or other types of fasteners) from the fastening device is a separate, distinct event.

SUMMARY

Fastening devices in accordance with the present invention allow a user to squeeze the handle to generate energy within the device and maintain that energy within the device as potential energy. When desired, the user can actuate a manually operable latch, which allows the potential energy stored within the device to be converted to kinetic energy in order to allow the ejection of a fastener. This allows users to more easily use a fastening device such as a manually operable staple gun for applications that were previously difficult. There are several known methods in which to generate potential energy for use in fastening devices.

In accordance with one aspect of the present invention, an improved fastening device is provided. The fastening device in accordance with the present invention includes a manually operable latch, which allows the user to store energy resulting from the compression of a compression spring in the fastening device until actuation of the manually operable latch. Upon actuation of the latch, a plunger of the fastening device moves in the direction of decompression of the compression spring and causes a fastener (such as, for example, staples, nails or other types of fasteners) to be ejected from the fastening device.

DETAILED DESCRIPTION

In accordance with an embodiment of the present invention, a fastening device, such as a forward acting stapler, is provided that includes a manually operable latch. The latch functions to retain potential energy stored in a compression spring of the fastening device created by operation of a manually operated handle. Upon actuation of the latch, the plunger within the fastening device is released, thereby converting the potential energy stored in the compression spring into kinetic energy and displacing a fastener (such as, for example, staples, nails or other types of fasteners) from the staple cartridge or magazine and forcefully dispelling the fastener from the device.

Figure 1:
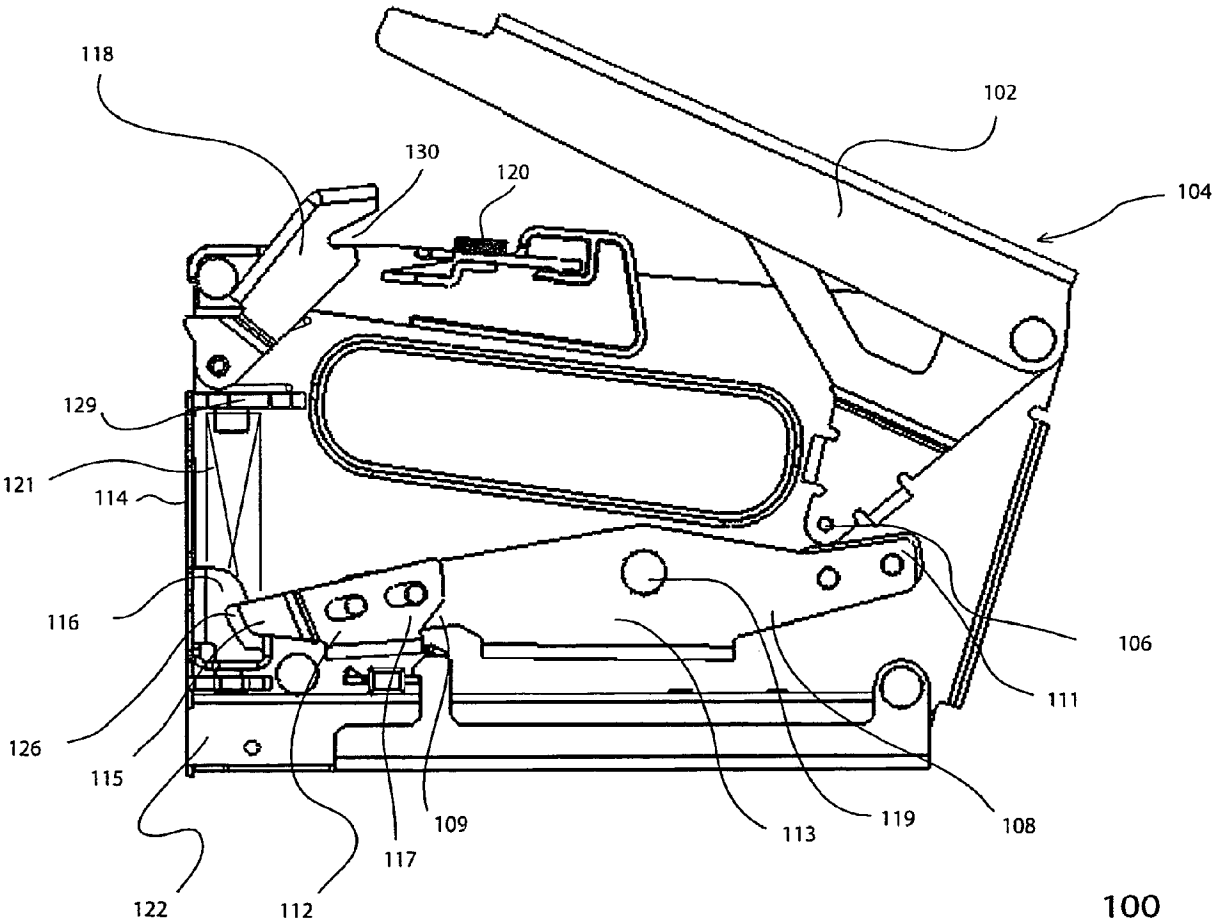
FIGS. 1 and 2 illustrate an exemplary embodiment of a fastening device in accordance with the teachings of the present invention.

A fastening device 100 is shown in FIG. 1. In the embodiment shown, the fastening device 100 is a manually operable staple gun and in particular, a forward acting manually operable staple gun. The fastening device 100 includes a handle assembly 104 that includes a manually operable handle portion 102, which is shown in FIG. 1 in a released position. The handle assembly 104 includes a roller 106. A lever arm 108 is provided that includes a first end 109, a second end 111 and a body portion 113. The first end 109 of the lever 108 includes a slider member 112 that has an engagement end 115 and a second end 117. The slider member 112 slides back and forth relative to the body portion 113 of the lever 108. A plunger 114 is provided. The movement of the plunger 114 causes fasteners such as, for example, staples, nails or other types of fasteners to be ejected from the fastening device 100. A spring housing 116 is provided that at least partially houses a compressions spring 121. The spring housing 116 may be integral with, or separately attached, to the plunger 114.

The spring housing 116 may preferable include a notch or recess 126 adapted to receive at least a portion of the engagement end 115 of the slider member 112. The slider member 112 is biased in a direction towards the notch or recess 126 by an extension spring 110 (not shown), which causes the engagement end 115 of the slider member 112 to remain in the notch or recess 126 and engage the spring housing 116. In operation, a user may depress the manually operable handle portion 102 downwardly, which in turn causes the handle assembly 104 (and roller 106) to move, which in turn causes the lever 108 (and thus the slider member 112) to pivot upwardly about axis 119. This pivoting action causes the engagement end 115 of the slider member 112 to move upwardly, thereby causing the spring housing 116 and the plunger 114 to also move upwardly. At the same time, the compression spring 121 is compressed. The compression spring 121 is mounted between spring restraint 129 and the spring housing 116, and potential energy is generated within the compression spring 121 as a result of the spring housing 116 and hence the plunger 114 being moved upwardly.

The spring housing 116 is moved upwardly to cause compression of the compression spring 121 in order to generate enough potential energy such that when the plunger 114 is released (as described below), the compression spring 121 will push the spring housing 116 and plunger 114 assembly downwardly in the direction of the decompression of the compression spring 121 in order to eject the fastener out of staple chamber 122 and affix the fastener to the desired surface. The decompression of the compression spring 122 occurs once the slider member 112 becomes disengaged with the spring housing 116, which occurs once the lever arm 108 forces the engagement end 115 end of the slider member 112 out of the notch or recess 126, thereby releasing the spring housing 116 and plunger 114 in the direction of decompression of the compression spring 121.

The fastening device 100 may preferably include a latch 118 that is manually operable. In this embodiment the latch 118 serves three primary functions. Firstly, the latch 118 catches and retains the plunger 114 in a raised position. Secondly, since the plunger 114 is assembled to the spring housing 116, the latch 118 effectively holds the spring housing 116 in a raised state which in turns keeps the compression spring 121 in a compressed state maintaining its potential energy. In this manner, the latch 118 serves to maintain the potential energy within the system. Thirdly, the latch 118 releases the plunger 114 when desired by the user. Upon release of the plunger 114, the stored energy in the compression spring 121 is released causing the plunger 114 to move downwardly in order to eject a fastener from the staple chamber 122. In operation, once the slider member 112 pivots upwardly to the point where the slider member 112 disengages from the notch or recess 126, the latch 118 preferably engages the plunger 114 with the compression spring 121 in a compressed state and thereby retaining the potential energy generated by the compression of the compression spring 121. The latch 118 can then be disengaged from the plunger 114 in order to allow decompression of the compression spring 121, which moves the spring housing 116 and the plunger 114 downwardly in the direction of decompression of the compression spring 121 in order to eject the fastener from the staple chamber 122.

It is contemplated that fastening devices in accordance with the present invention will thereby allow a user to generate potential energy to be used to drive a plunger 114 and to be able to store this energy and not instantly release the plunger 114. When desired the user can actuate the mechanism of the present invention to release the retained plunger 114 thereby causing a fastener to be ejected from the staple chamber 122. In one embodiment of this invention, the user compresses a compression spring 121 without instantly releasing the plunger 114 thereby causing a fastener to be ejected from the staple chamber 122.

It is further contemplated that the latch 118 may, in certain instances, not be utilized such that the latch 118 does not engage the plunger 114 in operation. This can be achieved, for example, by deactivating the latch 118 prior to depressing the manually operable handle portion 102 and in turn prior to any upward motion of the plunger 114 or compression of the compression spring 121. A latch lock 120 may be provided. The latch 118 can be deactivated when the latch lock 120 is pushed forward and engaged in notch 130, which will hold the latch 118 in a rotated, or open position. In this position, the latch 118 cannot "catch" the plunger 114, so that the fastening device 100 works like any traditional forward acting staple gun. It is also contemplated that the latch lock 120 in accordance with the present invention may also prevent accidental actuation of the latch 118. It is contemplated that those skilled in the art could employ several different methodologies to effectively hold the latch 118 in an open state.

Figure 2:
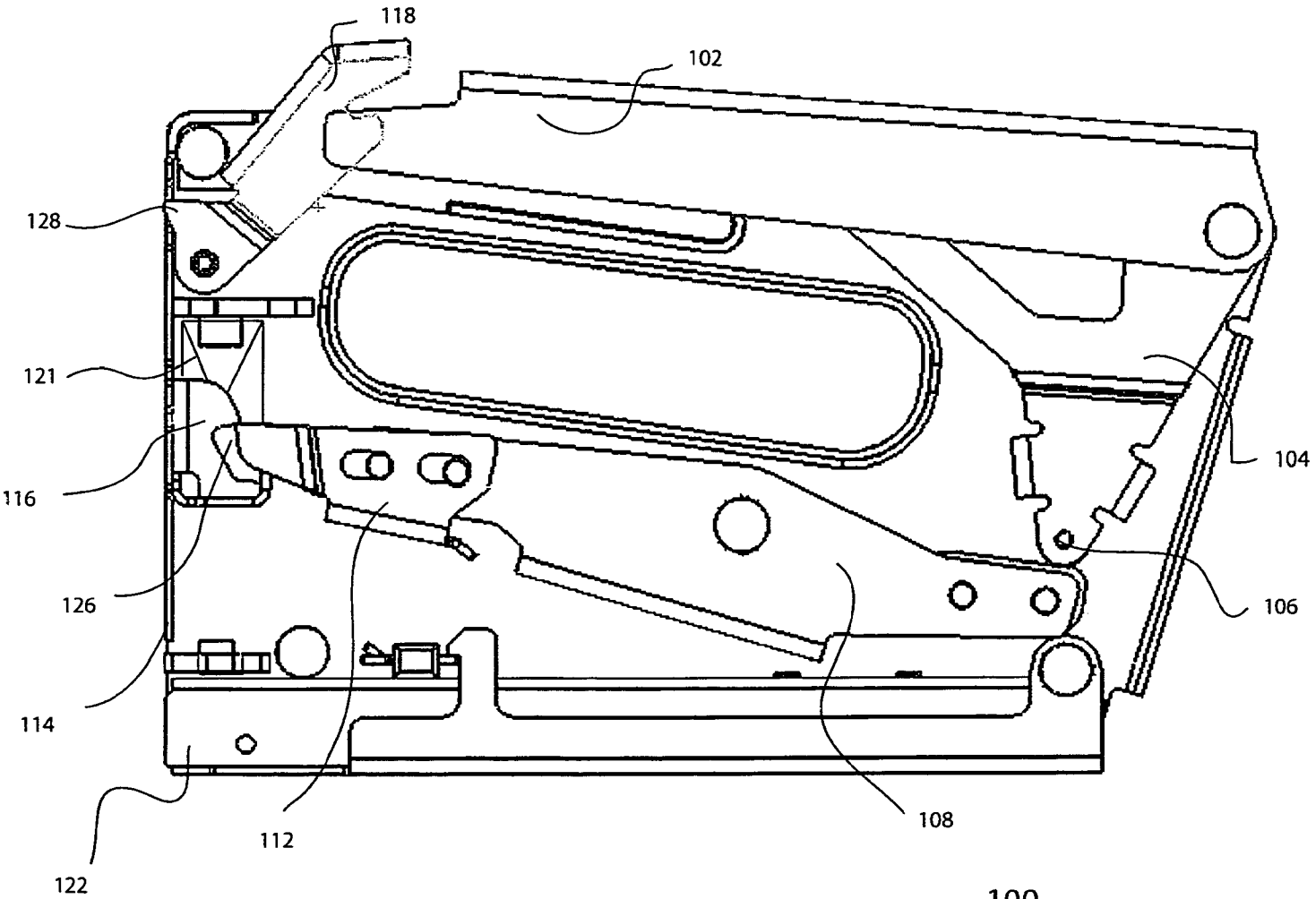

FIG. 2 shows the fastening device 100 of FIG. 1 with manually operable handle portion 102 depressed downwardly in a depressed position. As explained herein, depressing the handle portion 102 causes the handle assembly 104 to rotate, and with it the handle assembly roller 106 which acts on lever 108, causing lever 108 to move the slider member 112 upwardly. The slider 112 acts on the spring housing 116 raising it upwardly which in turn forces the compression of the compression spring 121 generating potential energy within the fastening device 100. Indeed, as shown in FIG. 2, the slider member 112 is about to disengage from the spring housing 116. In conventional forward acting fastening devices, this would cause the plunger 114 to instantly move in the direction of decompression of the compression spring 121 and eject a fastener (such as, for example, staples, nails or other types of fasteners) from the staple chamber 122. However, in accordance with embodiments of the present invention, the latch 118 will engage the plunger 114 just before the slider member 112 becomes disengaged with the notch or recess 126 formed in the spring housing 116. At the same time, the manually operable hand portion 102 can become engaged with the fastener device 100 body, thereby allowing a user access to the latch 118. Once the latch 118 has been actuated by the user, the plunger 114 will disengage from latch catch 128 and will move in the direction of decompression of the compression spring 121 and eject a fastener (such as, for example, staples, nails or other types of fasteners) from the staple chamber 122.

Figure 3A:
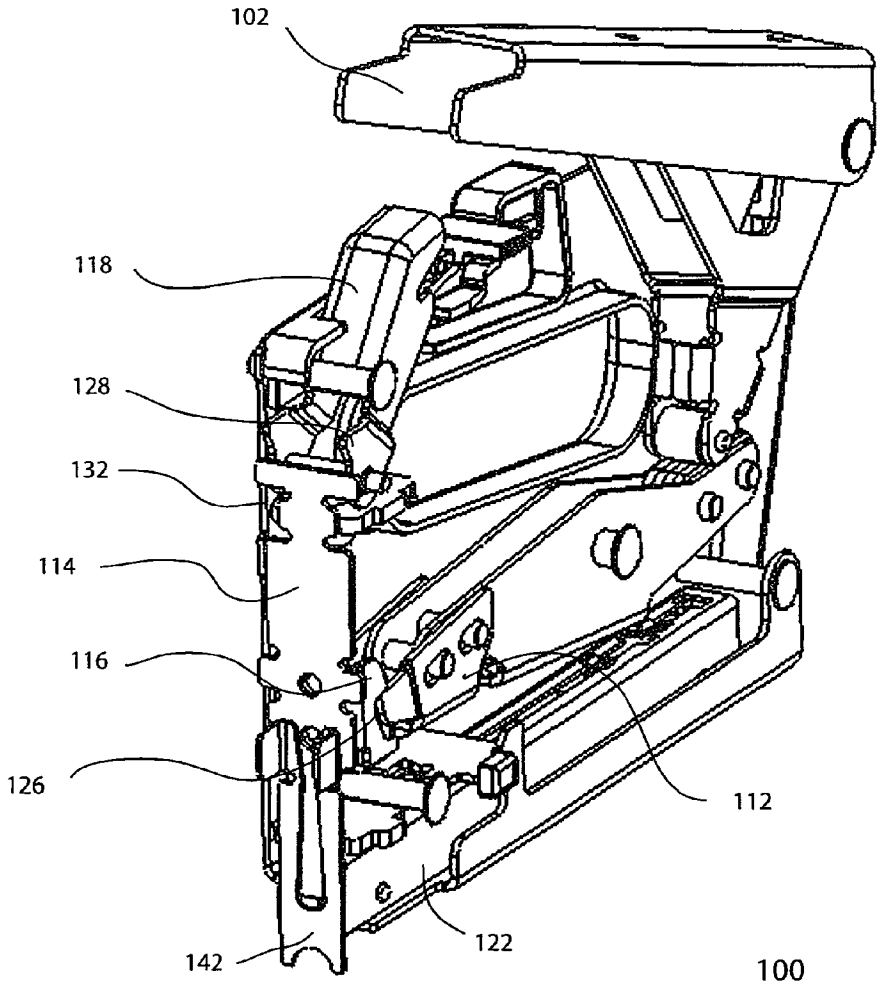
FIGS. 3A and 3B are perspective views of the fastening device shown in FIGS. 1 and 2.
Figure 3B:
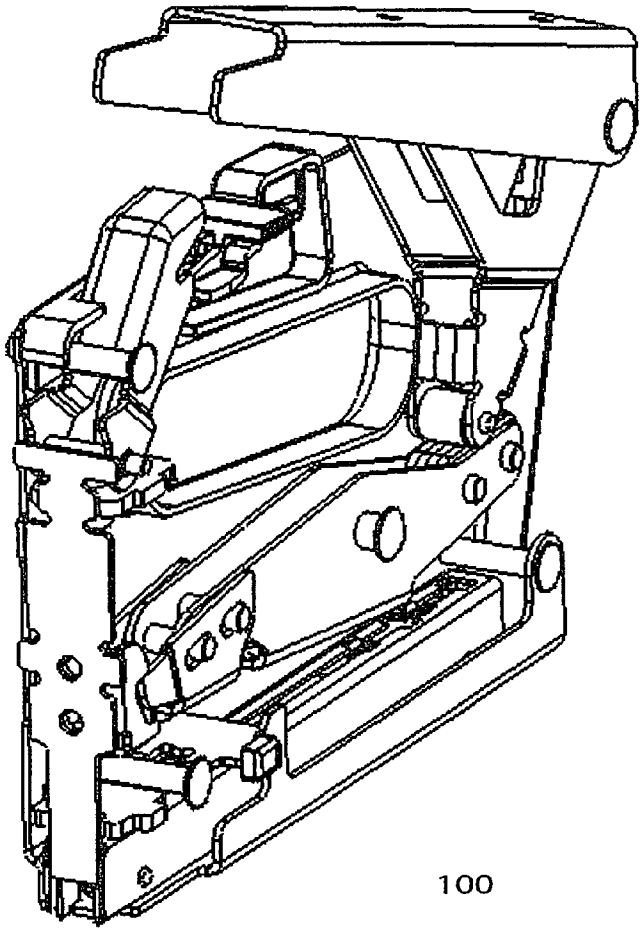

FIGS. 3A and 3B are perspectives view of the fastening device 100 shown with the outer cover removed. Shown in FIG. 3A, the upward movement of slider member 112 caused by the compression of the manually operable handle portion 102, causes compression of the compression spring 121 (see FIGS. 1 and 2) and results in the upwardly motion of the plunger 114 in the direction of compression of the compression spring 121 as previously described. The upward movement of the plunger 114 continues until the slider member 112 is no longer engaged with the spring housing 116 via the notch or recess 126. At this point, the plunger 114 has moved enough distance to have become slidably engaged to the latch 118 via the latch catch 128, which acts to "catch" and retain the plunger 114 at notch 132 formed in the plunger 114. Once the latch 118 is actuated by the user, the latch 118 rotates internally, thereby allowing the notch 132 in the plunger 114 to disengage from the latch catch 128. This allows the plunger 114 to move in the direction of decompression of the compression spring 121 (FIGS. 1 and 2) and eject a fastener from the staple chamber 122.

It is contemplated that fastening devices in accordance with embodiments of the present invention may optionally include a wire guide 142. The wire guide 142 is optionally included to ensure that, when actuating the latch 118, the device that is desired to be fastened is inline with where a fastener will be ejected from the fastening device 100. FIG. 3B shows the fastening device 100 without the wire guide 142 shown in FIG. 3A removed.

Figure 4:
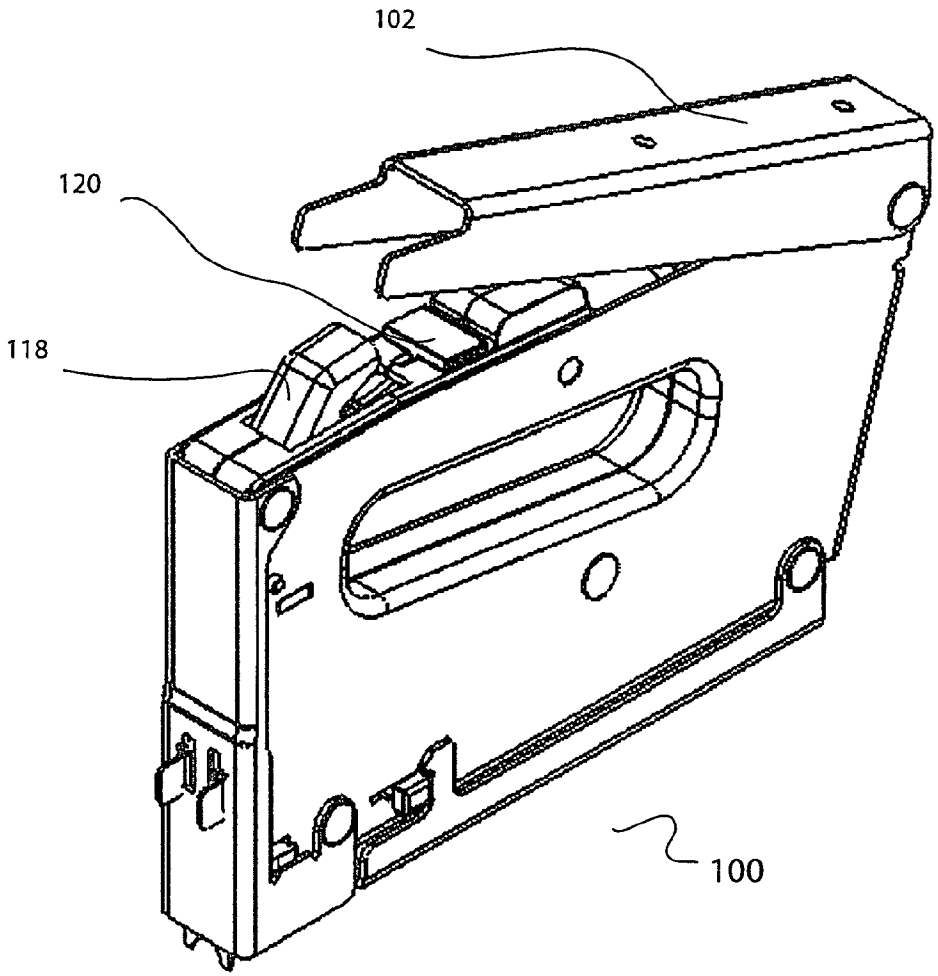
FIG. 4 shows the fastening device of FIGS. 3A and 3B with an outer cover attached.

FIG. 4 is another perspective view of the fastening device 100 shown with the cover installed, and the latch 118 can be seen. In operation, the user depresses the manually operable portion 102 of the fastening device 100, which creates stored energy within the fastening device 100. As long as the latch 118 is operable, then only upon actuation of the latch 118 is a fastener ejected from the fastening device 100. The latch 118 can also be locked out, either before the handle portion 102 is depressed or after the handle portion 102 is depressed by actuating the latch 118 and sliding the latch lock 120 so that it engages the latch 118 and holds it in an open state. It is contemplated that various configurations and methodologies may be employed for the latch lock 120 mechanism.

It is contemplated that the fastening device 100 of FIG. 4 may alternatively include a handle portion 102 that extends over and covers the latch 118. A button may preferably be placed on the outside of the handle portion 102, which upon pressing, will compress a spring within the handle portion 102 and be able to exit through a hole in the bottom of the handle portion 102 and be able to contact and impart a load on the latch 118 so that it can actuate the latch 118.

Figure 5A:
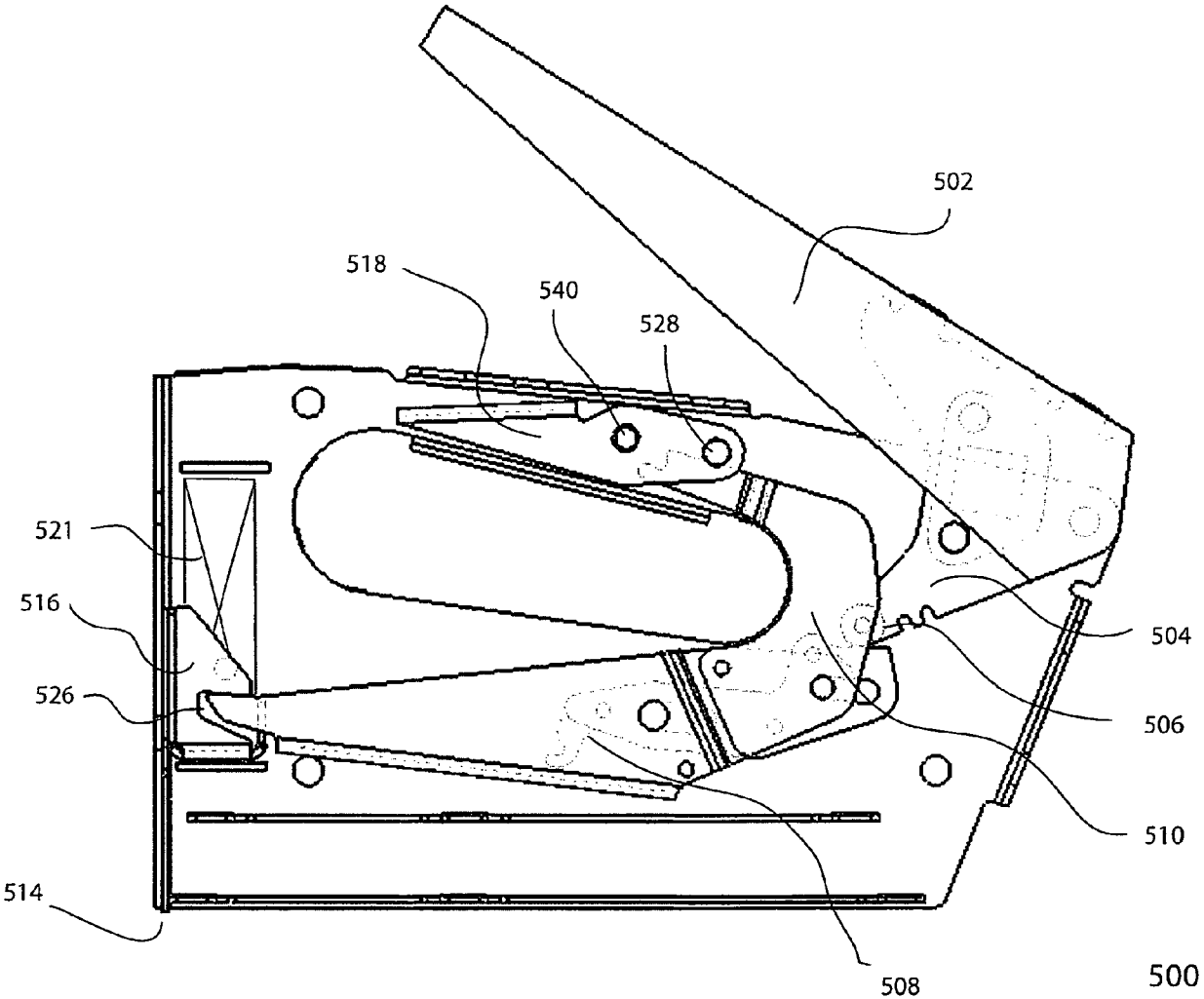
FIGS. 5A-5C illustrate another exemplary embodiment of a fastening device in accordance with the teachings of the present invention.
Figure 5B:
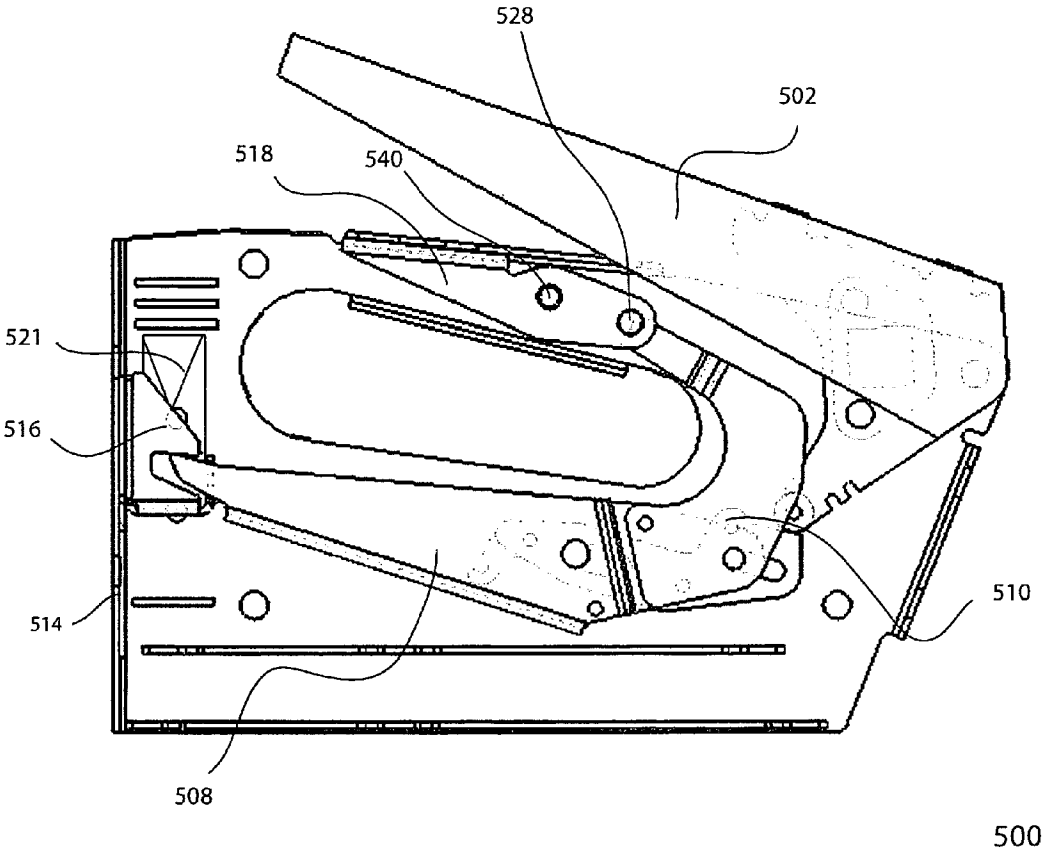
Figure 5C:
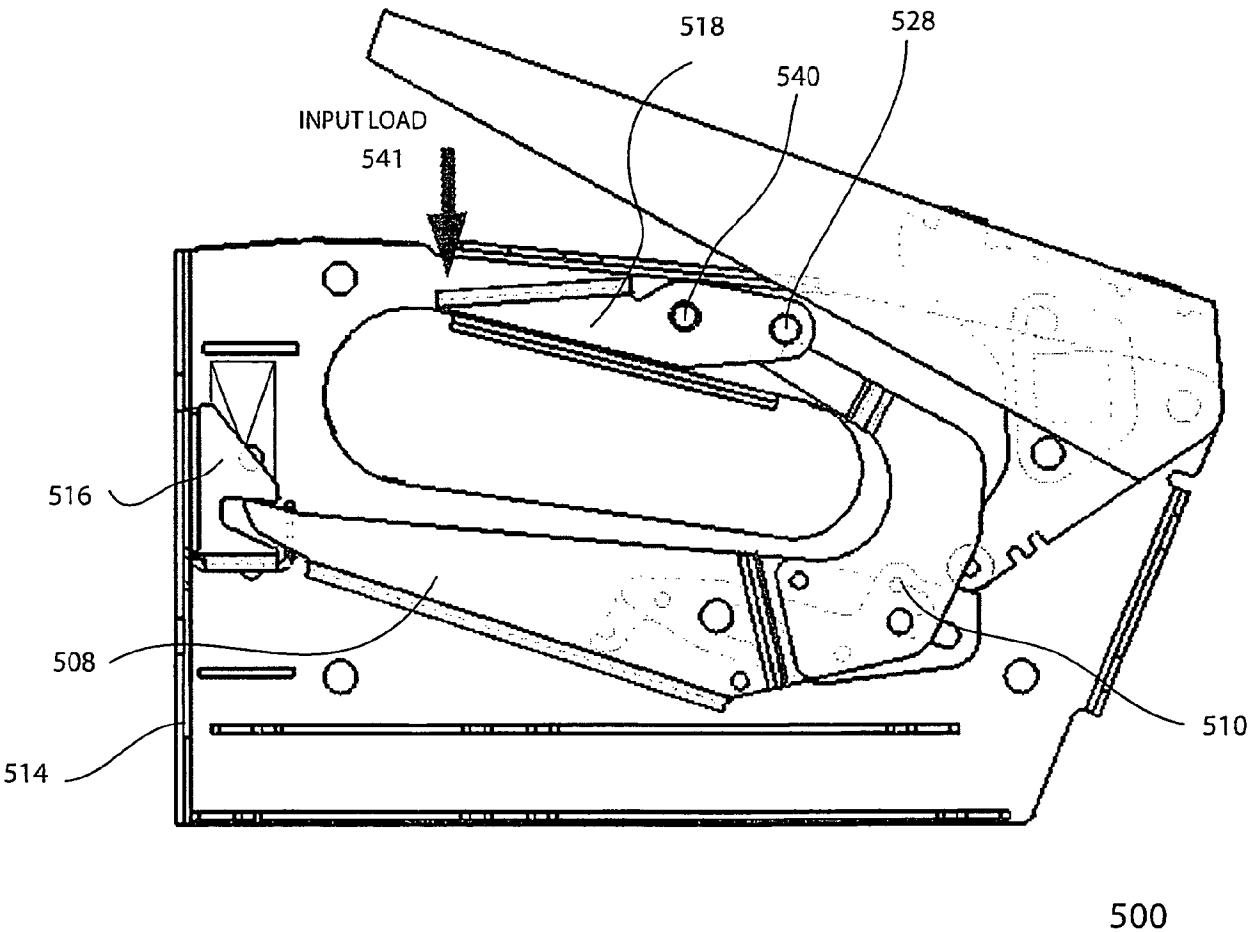

FIGS. 5A-5C illustrate yet another embodiment for a fastening device 500 in accordance with the present invention. In this embodiment, the user depresses the handle portion 502, which rotates the handle assembly 504 about a pivot point and causes the rotation of the lever 508 through the its contact with the handle assembly roller 506. Latch arms 510 are affixed to the lever 508, and rotate about the axis of the lever as the lever 508 moves. The end of the lever 508 which is opposite the roller 506 engages and rests within the notch or recess 526 in the spring housing 516. As the lever 508 is acted upon by the roller 506, the lever 508 lifts the assembly of the spring housing 516 and the plunger 514 thereby causing the compression of spring 521 which generates potential energy within the device 500. As the lever 508 rotates, so to do the latch arms 510. The latch arms 510 rotate and simultaneously act on the latch pin 528 which is affixed to the release actuator 518. The force exerted by the latch arms 510 on the latch pin 528 causes the release actuator 518 to rotate counter-clockwise about pivot axis 540. After sufficient rotation, the latch arms 510 lose contact with the latch pin 528 and the release actuator 518 rotates in its biased clockwise direction. The release actuator 518 is biased in a clockwise direction via a spring which is not shown. At a point in time near the full compression of the manually operable handle portion 502, the roller 506 arcs sufficiently to lose contact with the lever 508. The opposite end of the lever 508 is still engaged with the notch or recess 526. The compression spring 521 begins to decompress and imparts a downwardly directed load on the spring housing 516. Because of the engagement between the spring housing 516 and the lever 508, the downwardly movement of the spring housing 516 causes the counter-clockwise rotation of the lever 508 and in turn the latch arms 510. As illustrated in FIG. 5B, the latch arms 510 engage and catch on the latch pin 528. This engagement halts the motion of the latch arms 510 and in turn the lever 508. Since the end of the lever 508 is still engaged in the notch or recess 526, the downward motion of the spring housing assembly, comprised of the spring housing 516 and plunger 514, is also halted. This allows for the fastening device 500 to maintain the potential energy stored within the compression spring until its release is desired by the user. When the user imparts a load 541 on the end of the release actuator 518 opposite the latch pin 528, the release actuator 518 pivots about pivot axis 540 and disengages from the latch arms 510 as shown in FIG. 5C and allows for the continued movement of the spring housing 516 assembly as the latch arms 510 and in turn the lever 508, are no longer restrained. The plunger 514 will strike and expel a fastener from the device. Those skilled in the art will appreciate the many ways available to facilitate a means for the user to impart a load on the actuator 528.

Figure 6A:
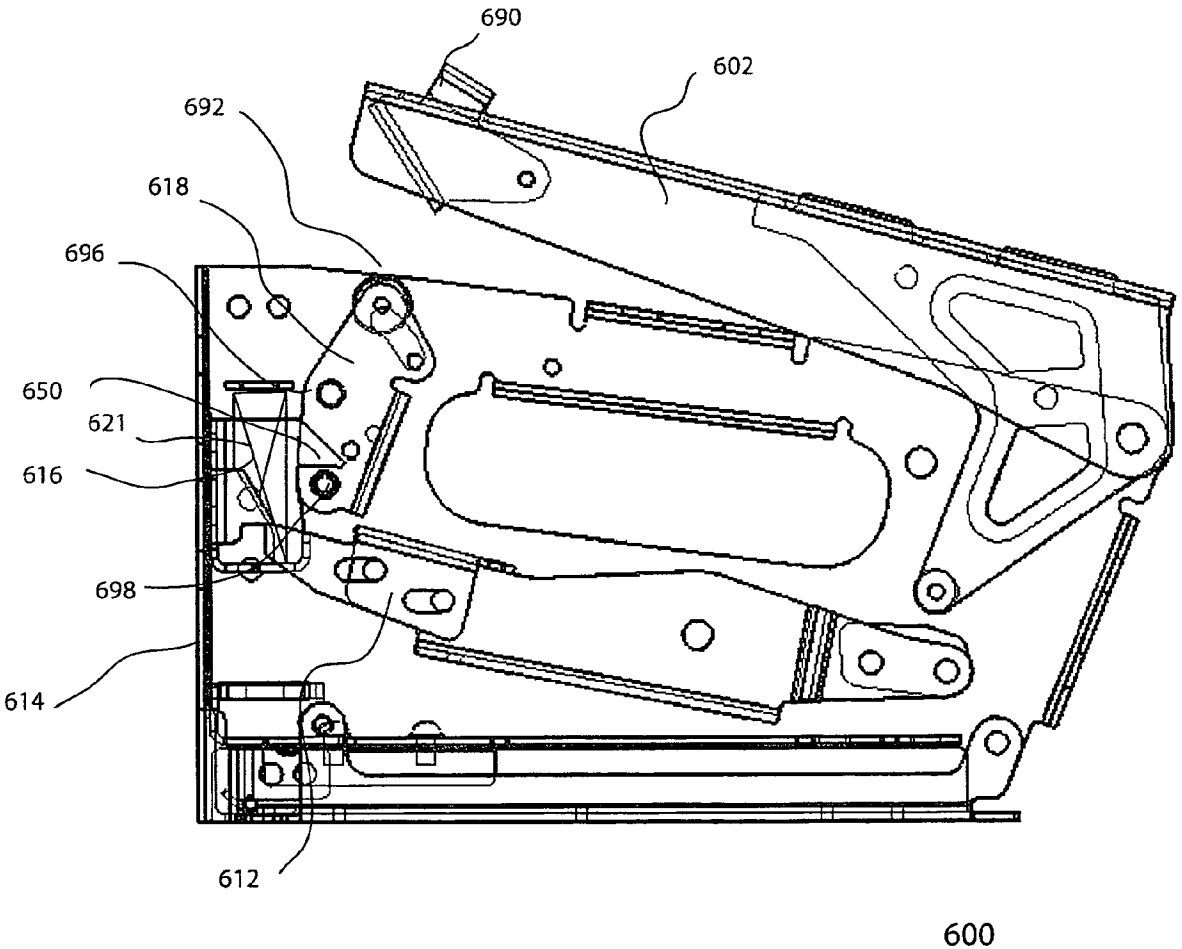
FIGS. 6A-6B illustrate yet another exemplary embodiment of a fastening device in accordance with the teachings of the present invention.
Figure 6B:
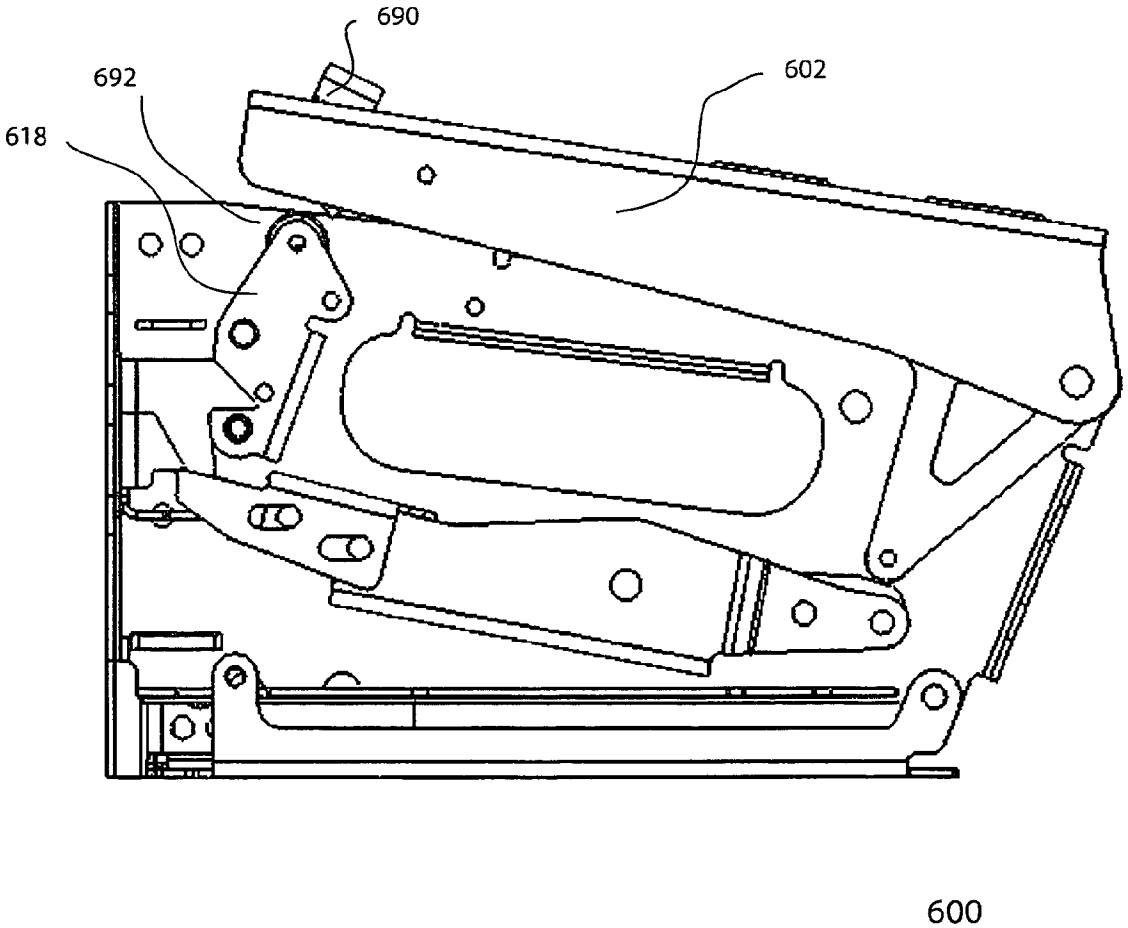

FIGS. 6A-6B illustrate still another embodiment of a fastening device 600 in accordance with the present invention. In FIG. 6A, a release actuator button 690 is located within the manually operable handle portion 602 of the fastening device 600. Depressing the manually operable handle portion 602 will cause the plunger 614 and spring housing 616 to move in an upwardly direction compressing the compression spring 621 as described in previous embodiments. By default, the extended tabs 650 of the spring housing 616 move through the latch pin 698 and then "catch" on the release actuator assembly 618. To do this, the release actuator assembly 618 pivots on the internal latch pivot 696. Thus, even with the slider 612 disengaging from the spring housing 616 upon full stroke of the handle 602, the compression spring will stay compressed as the housing 616, and in turn the plunger 614, are retained in an upwardly position by the release actuator assembly 618 and therefore the plunger 614 is not allowed to move and eject a fastener from the staple chamber. Pressing of the release actuator button 690 will cause the release actuator assembly 618 to move at the point of the roller 692. This causes the release actuator assembly 618 to pivot and disengage from the spring housing 616 and allows the compression spring to decompress, thereby moving the spring housing 616 and plunger 614 in the direction of decompression in order to eject a fastening device from the staple chamber.

FIG. 6B shows a fastening device 600 with the handle 602 in a depressed (or compressed) state. As can be seen, the release actuator button 690 will engage the release actuator assembly 618 by contacting the roller 692.

Figure 7A:
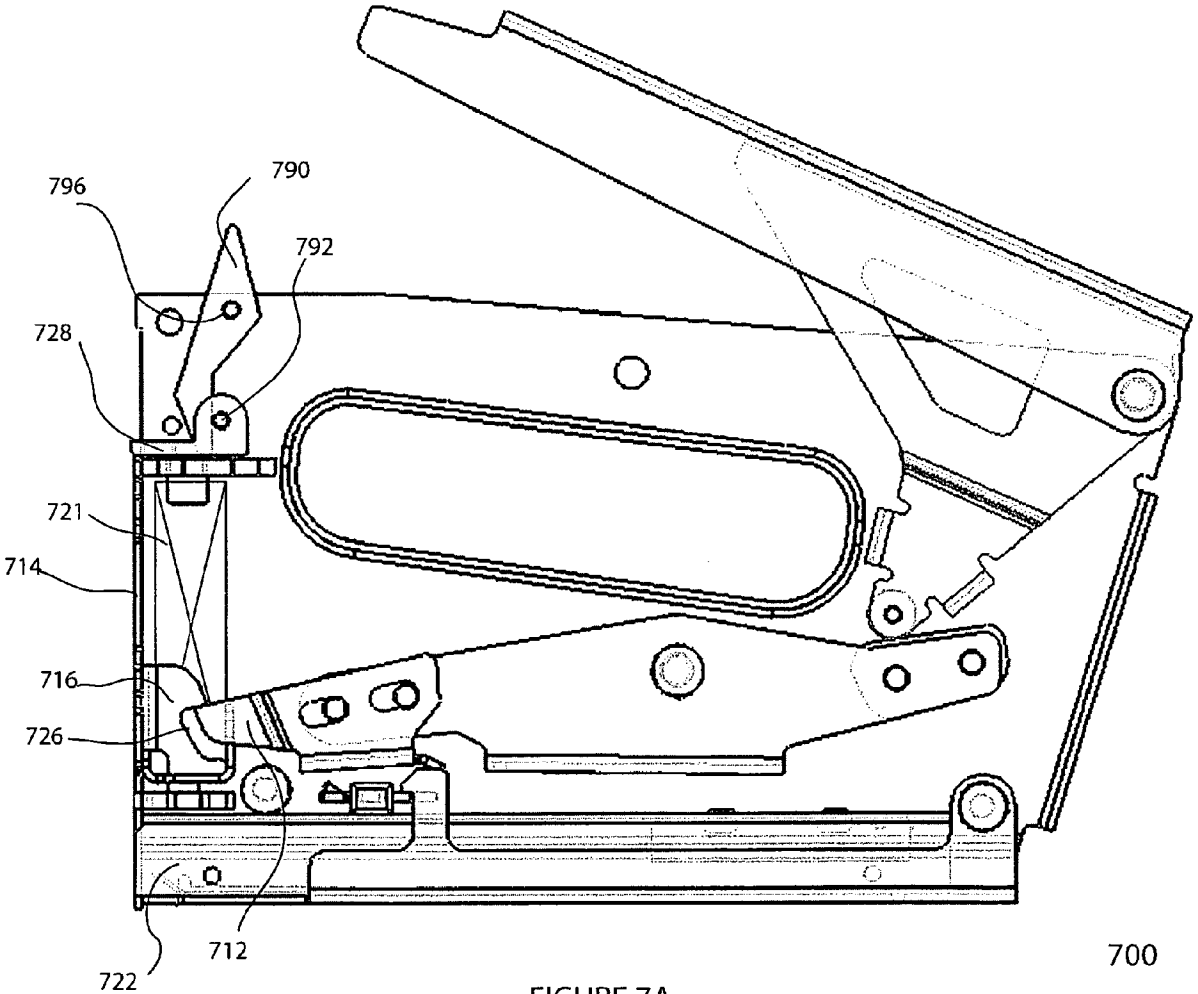
FIGS. 7A-7B illustrate a further exemplary embodiment of a fastening device in accordance with the teachings of the present invention.
Figure 7B:
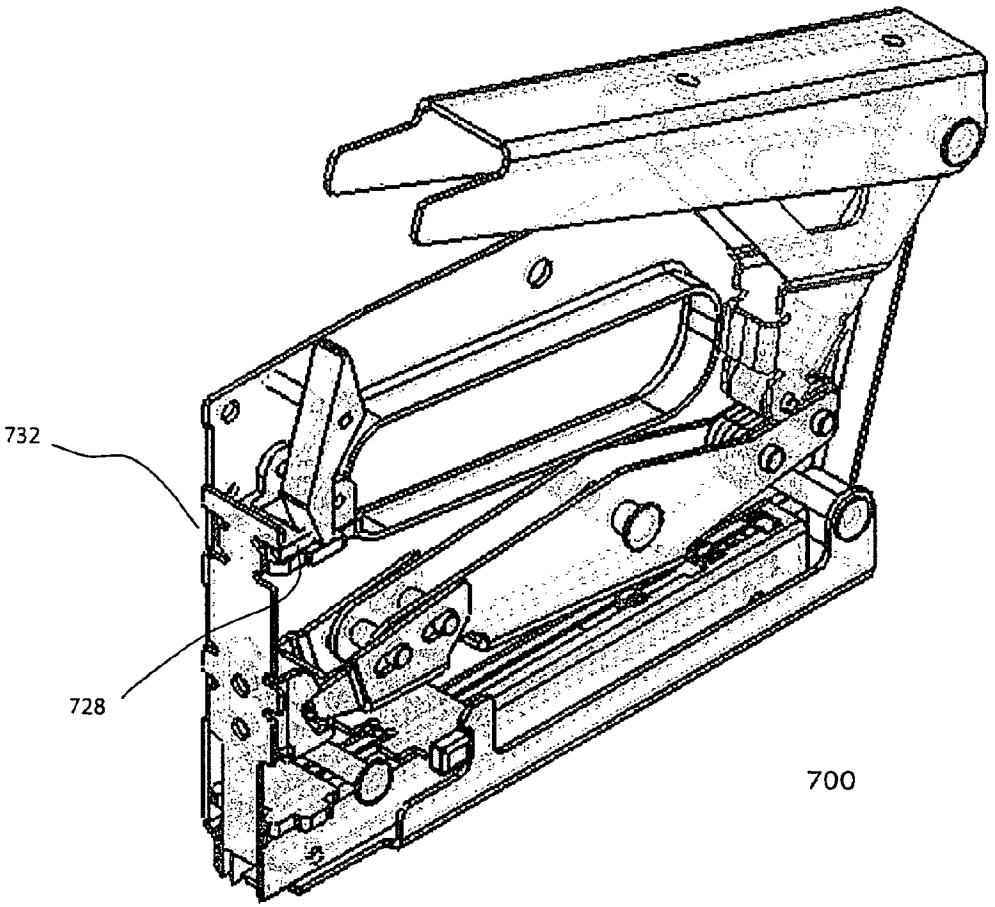

FIGS. 7A-7B illustrate yet another embodiment of a fastening device 700 in accordance with the present invention. In the embodiment shown in FIG. 7A, the fastening device 700 operates similarly to fastening device 100 shown in FIG. 1. One difference in this embodiment is that as the plunger 714 and spring housing 716 assembly is raised, which increases the potential energy of the compression spring 721, the plunger 714 in turn pushes on a sliding latch component 728 which moves laterally towards the rear of the fastening device 700. The sliding latch component 728 is biased by a spring (not shown) towards the front of the fastening device. As in the case of the embodiment of a fastening device in FIG. 3, the movement of the plunger 714 continues until the slider 712 is no longer engaged with the notch or recess 726. At this point, the plunger 714 has moved enough distance to have become slidably engaged to the sliding latch component 728 which acts to "catch" the plunger at the plunger notch 732 (best viewed in FIG. 7B). Once the release actuator 790 is actuated, the release actuator rotates about a pivot 796, and the opposite end of the release actuator 790 acts against a roller 792 which is affixed to the sliding latch component 728, and causes the sliding latch component 728 to move against its bias and slide laterally towards the rear of the staple gun 700. The sliding latch component 728 becomes disengaged from the plunger 714 and as a result, the plunger 714 moves in the direction of decompression of the compression spring 721 and ejects a fastener from the staple chamber 722.

Figure 8A:
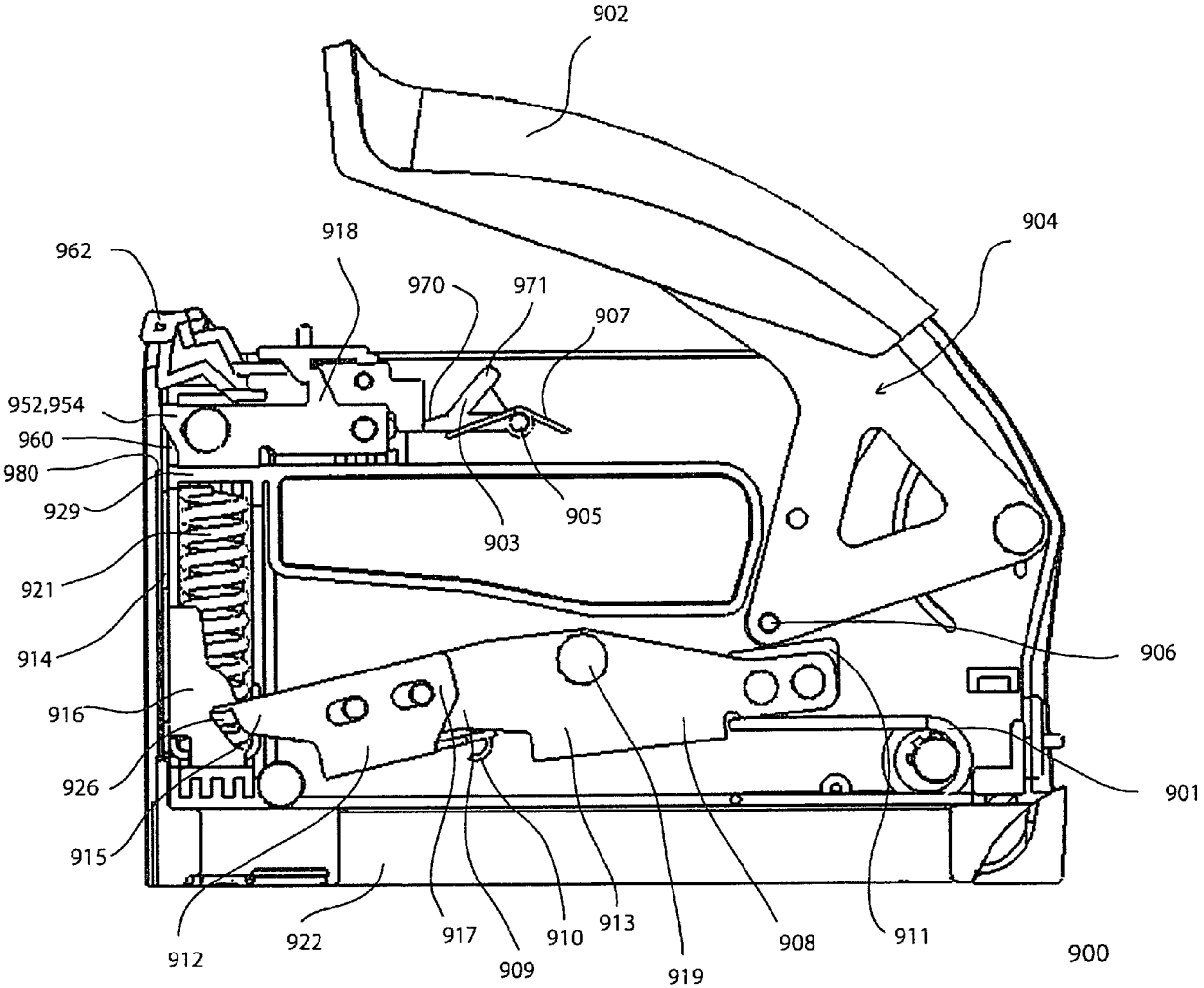
FIGS. 8A-8J illustrate a further exemplary embodiment of another fastening device in accordance with the teachings of the present invention.
Figure 8B:
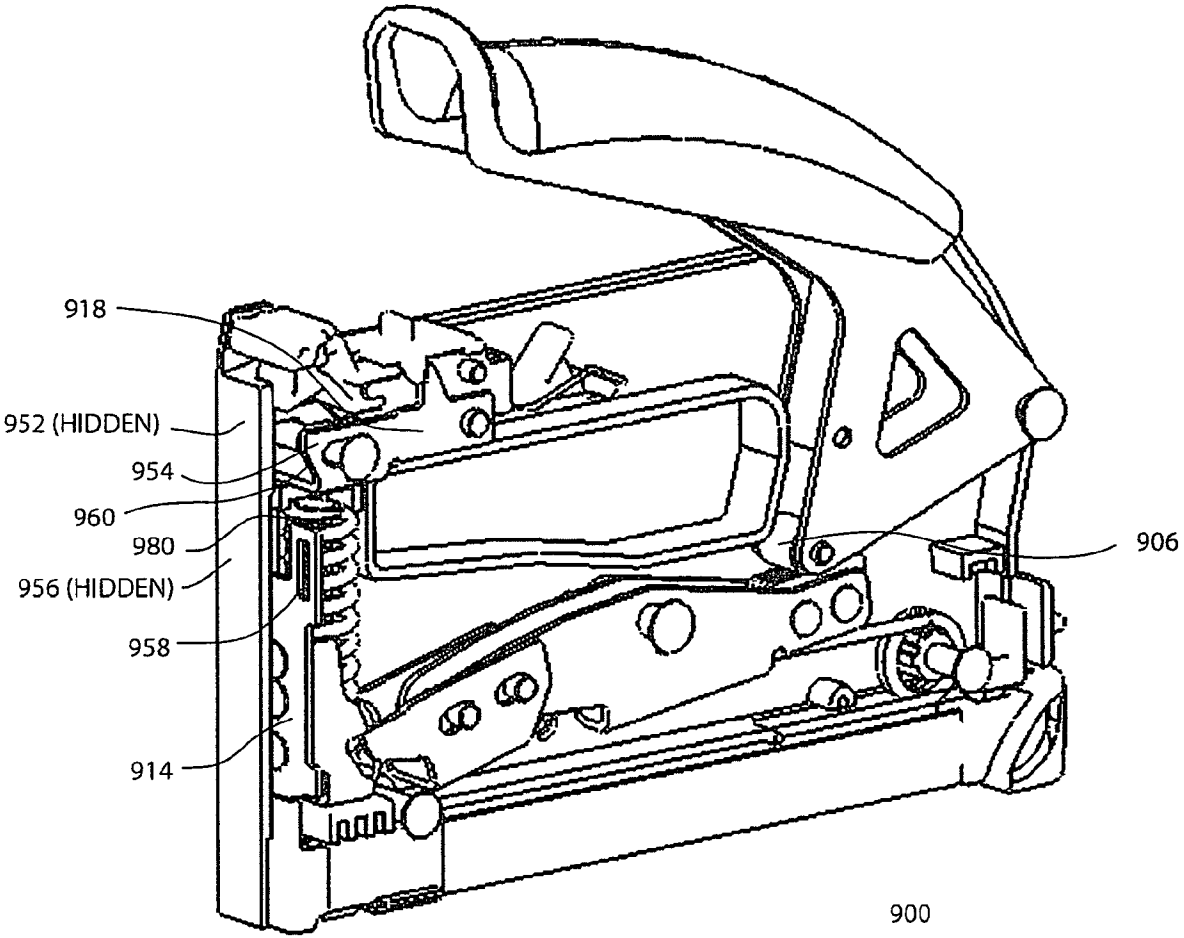

FIGS. 8A-8J show an alternative embodiment of a fastening device 900 in accordance with the present invention. Referring to FIG. 8A, the fastening device 900 includes a handle assembly 904 that include a manually operable handle portion 902. FIGS. 8A and 8B show the handle portion is a released position. The handle assembly 904 includes a roller 906 (better illustrated in FIG. 8B). A lever arm 908 is provided that includes a first end 911, a second end 909 and a body portion 913. The first end 911 of the lever arm 908 is biased upwardly in a counter clock-wise direction against the handle assembly 904 (and in particular against the roller 906) by torsion spring 901.

The second end 909 of the lever arm 908 includes a slider member 912 that has an engagement end 915 and a second end 917. The slider member 912 slides back and forth relative to the body portion 913 of the lever arm 908.

As shown in FIG. 8B, a plunger 914 is provided. As is common in many fastening devices known through prior art, the movement of the plunger 914 causes fasteners such as, for example, staples, nails or other types of fasteners to be ejected from the fastening device 900. A spring housing 916 is provided that at least partially houses a compression spring 921. The spring housing 916 may be integral with, or separately attached, to the plunger 914.

The spring housing 916 may preferable include a notch or recess 926 adapted to receive at least a portion of the engagement end 915 of the slider member 912. The slider member 912 is biased in a direction towards the notch or recess 926 by an extension spring 910, which causes the engagement end 915 of the slider member 912 to remain in the notch or recess 926 and engage the spring housing 916. In operation, a user may depress the manually operable handle portion 902 downwardly, which in turn causes the handle assembly 904 (and roller 906) to move, which in turn causes the lever arm 908 (and thus the slider member 912) to pivot in a clockwise direction about axis 919. This pivoting action causes the engagement end 915 of the slider member 912 to move upwardly, thereby causing the plunger 914 to also move upwardly. At the same time, the compression spring 921 is compressed. The compression spring 921 is mounted between spring restraint 929 and the spring housing 916, and stores energy that is generated within the compression spring 921 as a result of the spring housing 916 and hence the plunger 914 being moved upwardly.

The spring housing 916 is moved upwardly to cause compression of the compression spring 921 in order to generate enough potential energy such that when the plunger 914 is released (as described below), the compression spring 921 will push the spring housing 916 and plunger 914 assembly downwardly in the direction of the decompression of the compression spring 921 in order to eject the fastener out of staple chamber 922 and affix the fastener to the desired surface. The decompression of the compression spring 921 occurs once the slider member 912 becomes disengaged with the spring housing 916, which occurs once the lever arm 908 forces the engagement end 915 of the slider member 912 out of the notch or recess 926, thereby releasing the spring housing 916 and plunger 914 in the direction of decompression of the compression spring 921.

The fastening device 900 may preferably include a latch 918 that is manually operable. The latch 918 serves the functions of (1) retaining the plunger 914 in a raised position while the compression spring 921 is in a compressed state thereby maintaining the potential energy within the device 900 and (2) releasing the plunger 914. In operation, once the slider member 912 pivots upwardly to the point where the slider member 912 disengages from the notch or recess 926, the latch 918 preferably engages the plunger 914 with the compression spring 921 in a compressed state thereby retaining the potential energy generated by the compression of the compression spring 921. The latch 918 can then be disengaged from the plunger 914 in order to allow decompression of the compression spring 921, which moves the spring housing 916 and the plunger 914 downwardly in the direction of decompression of the compression spring 921 in order to eject the fastener from the staple chamber 922.

Figure 8C:
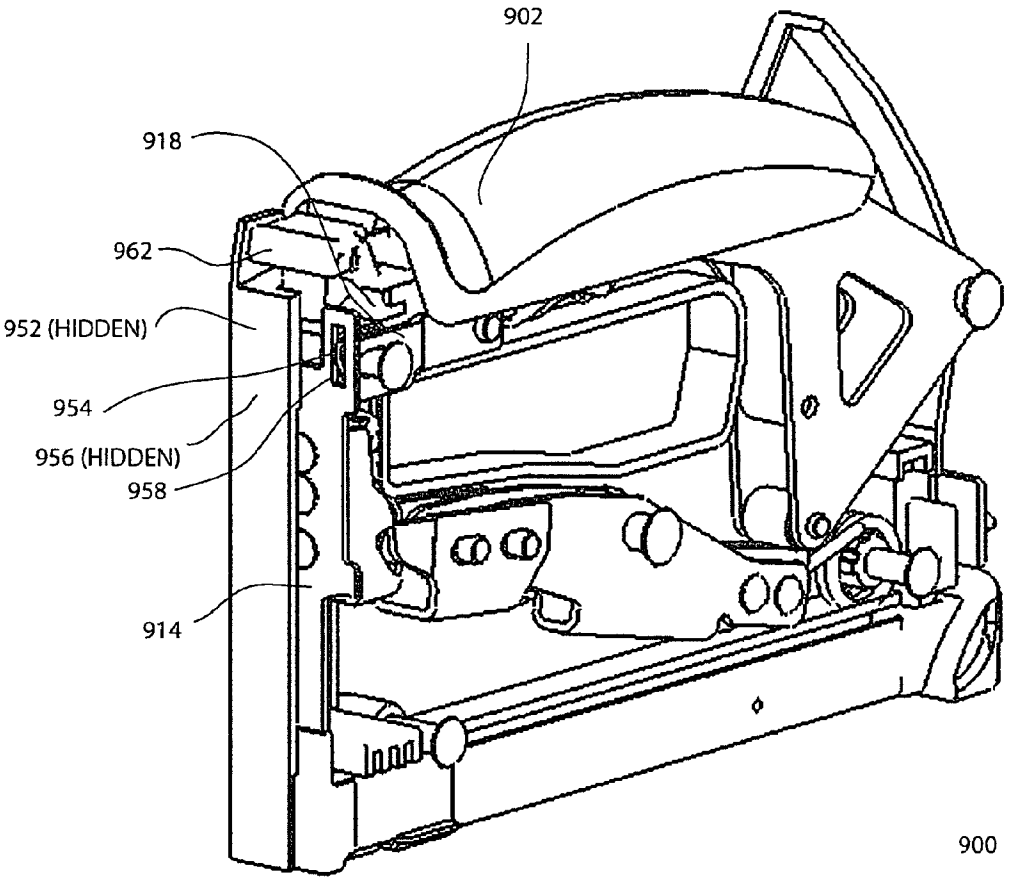

The latch 918 is mounted to the fastening device 900 such that it can slide from left to right and from right to left in a horizontal fashion. An extension spring 950 (not shown) is included that biases the latch 918 to the left in a direction toward the plunger 914. As shown in FIG. 8B, the latch 918 includes catch portions 952 (hidden in the figure) & 954 that engage and retain the plunger 914 when the compression spring 921 is in a compressed state. The plunger 914 preferably includes slots 956 (hidden in the figure) and 958 that receive the catch portions 952, 954. The slots 956 can be any suitable means for engaging the latch, such as bosses, protrusions, holes, ridge or other shape as long as a cooperating member is suitable formed on the latch for engaging therewith. As shown in FIG. 8A, the latch 918 also includes a ramp portion 960. In operation, when the plunger 914 is forced upwardly, the top edge 980 of the plunger 914 engages the ramp portion 960 thereby urging the latch 918 in a direction from left to right away from the plunger 914. The top edge 980 of the plunger 914 and the ramp portion 960 of the latch 918 are better shown in FIG. 8B. The plunger 914 continues to move upwardly until the slots 956 and 958 reach the catch portions 952, 954 at which point the latch 918 moves from right to left as a result of the spring bias caused by extension spring 950 (not shown) thereby causing the catch portions 952, 954 to be inserted into slots 956, 958 such that the plunger 914 can be retained by the latch 918. FIG. 8C shows the plunger 914 retained by the latch 918, and in particular, the catch portions 952, 954 inserted into slots 956, 958. FIG. 8C also shows the manually operable handle portion 902 in a depressed position.

As shown in FIG. 8A, the latch 918 also includes a manually operable portion 962 that allows the latch 918 to be manually actuated. In this embodiment, the manually operable portion 962 acts on the latch 918 in the same manner that the release actuator 790 acted on the sliding latch component 728 within device 700 from the embodiment shown in FIG. 7A. For example, when the plunger 914 is retained by the latch 918 (as a result of the catch portions 952, 954 being inserted in the slots 956, 956 as shown in FIG. 8C), the latch 918 can be actuated by a user by depressing the manually operable portion 962. When this occurs, the latch 918 slides laterally such that the catch portions 952, 954 are moved from left to right in a direction away from the plunger 914. When the catch portions 952, 954 exit the slots 956, 958 and clear the plunger 914, the plunger 914 is released and the decompression of the compression spring 921 results in the downwardly movement of the plunger 914.

Figure 8D:
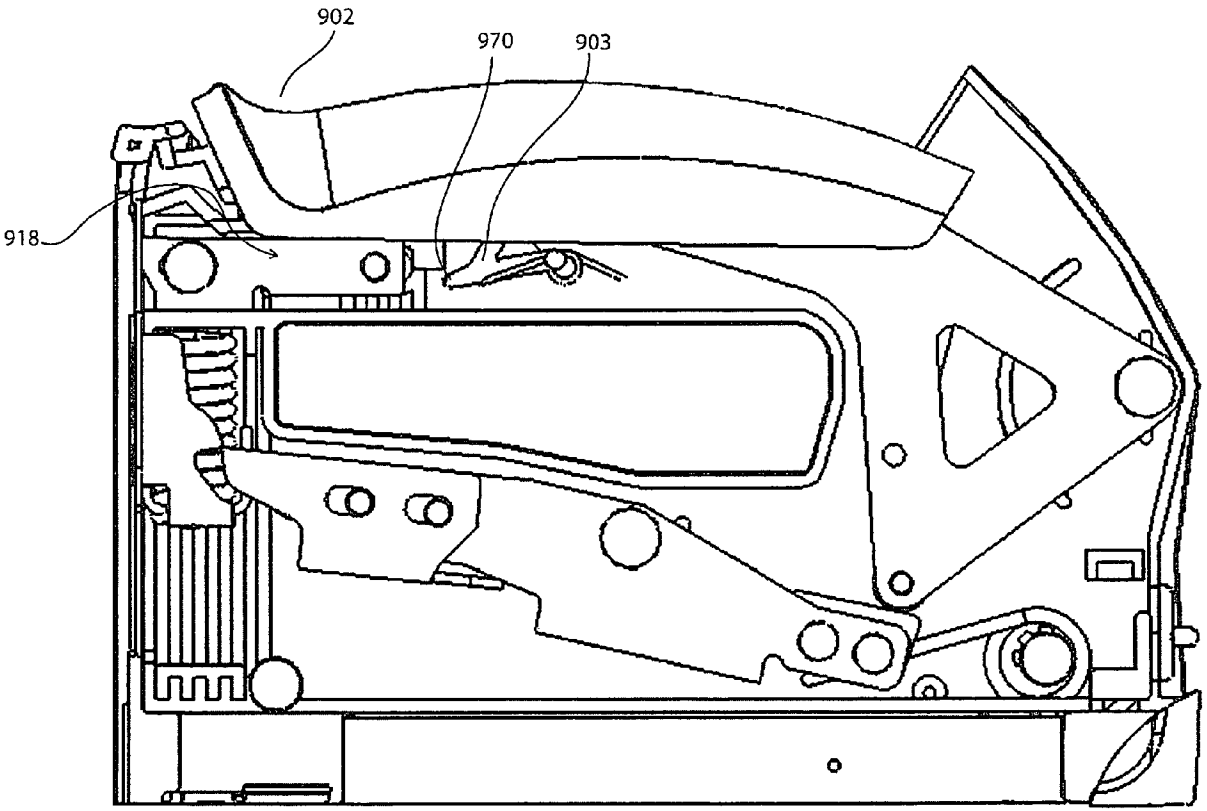

Referring again to FIG. 8A, a safety lever 903 may preferably be provided that rotates about axis 905. The safety lever 903 is biased in a clock-wise direction by torsion spring 907. The safety lever 903 has two ends. One end 971 is acted upon by the handle assembly 904 when the handle assembly 904 is decompressed. The other end 970 of the safety lever 903 prevents the latch 918 from actuating when the manually operable handle portion 902 is in the raised or released position as shown in FIG. 8A by effectively blocking the rotation and impairing the actuation of the manually operable portion 962 of the latch. As shown in FIG. 8D, when the manually operable handle portion 902 is depressed, the end 970 of the safety lever 903 rotates downwardly so that the end 970 of the safety lever 903 no longer interferes with the operation of the latch 918.

Figure 8E:
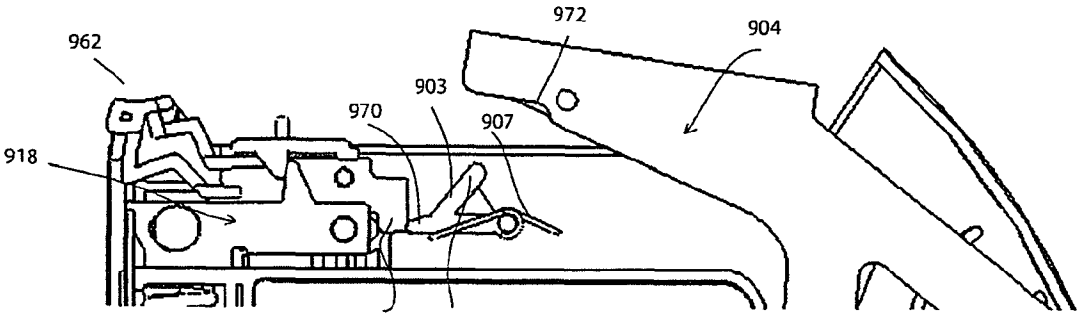
Figure 8F:
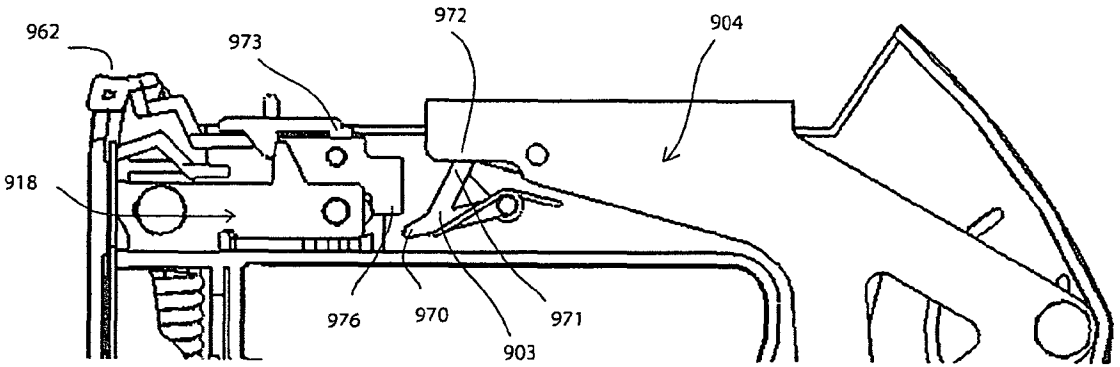
Figure 8H:
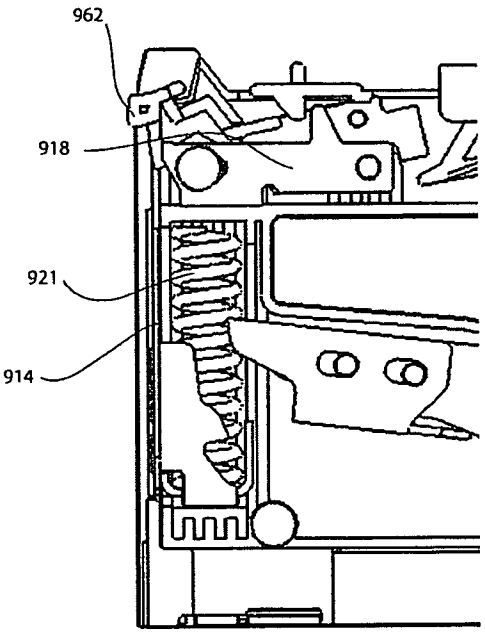
Figure 8G:
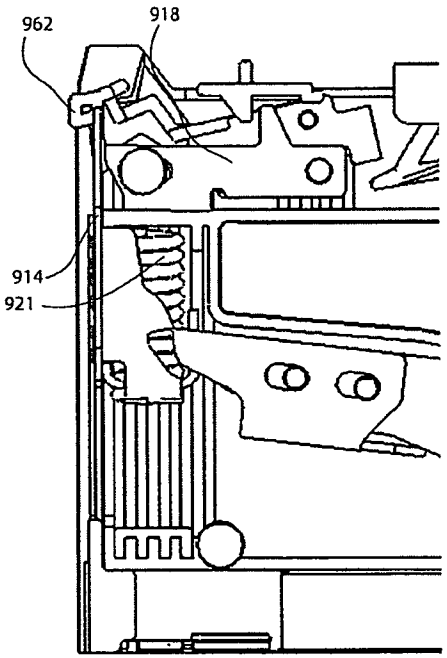

FIGS. 8E-8F show step by step the depression of the handle 904 through the step of the contact point 972 of the handle 904 contacting the safety lever 903 at end 971 thereby rotating it away from its contact with one end 976 of the manually operable portion 962 of the latch 918. FIGS. 8G-8H show step by step the depression of the manually operable portion 962 of the latch 918 through the step of the disengagement and release of the plunger 914 from the latch 918 and the decompression of the compression spring 921 as previously described.

Figure 8I:
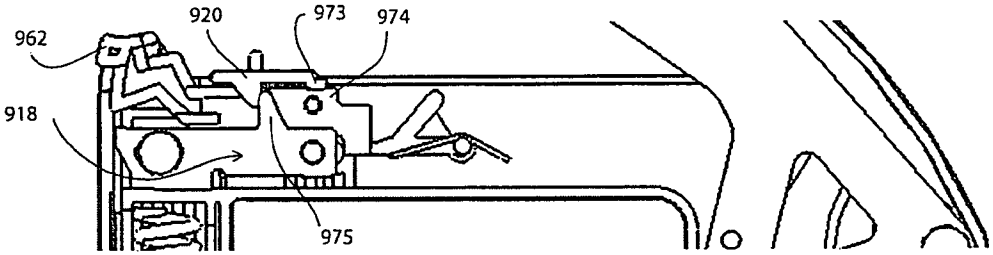
Figure 8J:
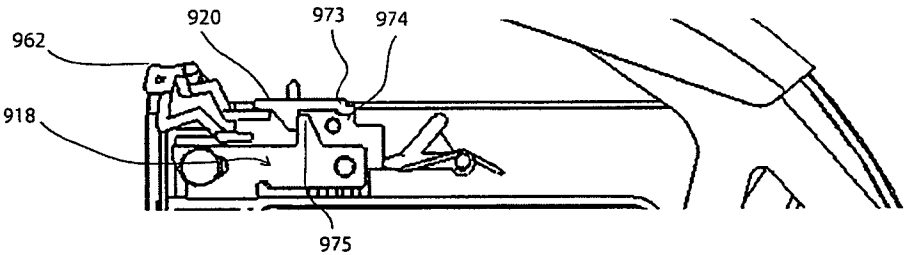

It is contemplated that fastening devices in accordance with the present invention will thereby allow a user to generate and store potential energy within a manually actuated fastening device 900 without instantly releasing the plunger 914 thereby causing a fastener to be ejected from the staple chamber 922. It is further contemplated that the latch 918 may, in certain instances, may be deactivated such that the latch 918 does not engage the plunger 914 in operation. When the latch 918 is deactivated, the latch 918 cannot "catch" and retain the plunger 914, so that the fastening device 900 works like any conventional forward acting staple gun. As shown through FIGS. 8I-J the latch 918 may be deactivated by sliding the latch lock 920 from left to right engaging the latch 918 such that the latch 918 slides from left to right, and then keeps the latch 918 in this open position. When the latch 918 is kept in this open position, the latch cannot "catch" and retain the plunger 914. It is contemplated that those skilled in the art could employ several different methodologies to effectively deactivate the latch 918. For example, a pin (not shown) may be inserted through an opening (not shown) in the latch 918 that would keep the latch 918 in the open position. FIGS. 8I-J illustrates how the latch lock 920 is slide from left to right thereby slidably engaging the latch 918 at latch tab 975 thereby forcing the latch 918 to the right. With the latch 918 held to the right, it cannot engage nor retain the plunger. Furthermore, with the latch lock 920 slid towards the rear of the device, one end 973 of the latch lock 920 engages the end 974 of the manually operable portion 962 of the latch 918 in such a manner as to block the rotation of the manually operable portion 962 of the latch 918.

In operation, when the latch 918 is not deactivated, the manually operable handle portion 902 is depressed downwardly by the user. As explained herein, the depression of the handle portion 902 causes the handle assembly 904 to rotate, and with it the handle assembly roller 906 which acts on lever arm 908, causing lever arm 908 to move the slider member 912 in a generally upward direction so as to compress the compression spring 921. In other words, as the slider member 912 moves upward, the spring housing 916 and the plunger 914 also move upward, which causes compression of the compression spring 921. The movement of the plunger 914 continues until the slider member 912 is no longer engaged with the spring housing 916 via the notch or recess 926. At this point, the plunger 914 has moved enough distance to have become slidably engaged to the latch 918 via the catch portions 952, 954, which act to "catch" or retain the plunger 914 at the slots 956, 958 formed in the plunger 914. In other words, the latch 918 will engage and retain the plunger 914 once the slider member 912 becomes disengaged with the notch or recess 926 formed in the spring housing 916.

The manually operable handle portion 902 can become engaged with the fastener device 900 body, thereby allowing a user access to the manually operable portion 962 of the latch 918. Once the latch 918 has been actuated by the user through the depression of the manually operable portion 962, the latch 918 slides laterally from left to right allowing the plunger 914 to disengage from the catch portions 952, 954 of the latch 918. This allows the plunger 914 to move downwardly in the direction of decompression of the compression spring 921 and eject a fastener from the staple chamber 922.

The invention has been described with reference to the preferred embodiments. Obviously, modifications and alterations will occur to others upon a reading and understanding of this specification. It is intended that the invention be construed as including all such modifications and alterations insofar as they come within the scope of the appended claims or the equivalents thereof. It is also contemplated that embodiments in accordance with the present invention can be adapted and used with rearward acting fastening devices such as rearward acting staplers as well.

The invention claimed is:

1. A fastening device comprising:

a housing, a manually operable handle, a plunger for ejecting fasteners from the fastening device, a spring adapted to control movement of the plunger wherein the spring is operable between a decompressed state and a compressed state upon depression of the handle, a manually operable latch protruding from the housing and operably mounted on said housing apart from the handle, wherein said manually operable latch is configured for retaining the plunger when the spring is in the compressed state thereby storing energy generated from compression of the spring and for releasing the plunger upon direct actuation of the manually operable latch by a user to cause a fastener to be ejected from the fastening device, and a safety lever operatively connected to the fastening device wherein the safety lever prevents the manually operable latch from actuating when the manually operable handle is in a released position and wherein the safety lever allows the manually operable latch to actuate when the manually operable handle is in a depressed position.

2. The fastening device of claim 1 wherein the fastening device is a manually operated stapler.

3. The fastening device of claim 1 wherein the fastening device is a rearward acting stapler.

4. The fastening device of claim 1 wherein the fastening device is a forward acting stapler.

5. The fastening device of claim 1 wherein the manually operable latch is adapted to act directly on the plunger.

6. The fastening device of claim 1 wherein the manually operable latch is adapted to act indirectly on the plunger.

7. The fastening device of claim 1 wherein the manually operable latch acts on and retains a spring housing, and the plunger is mechanically attached to the spring housing.

8. The fastening device of claim 1 wherein the manually operable latch acts on the plunger, and wherein the plunger includes an integral spring housing with an end of the spring positioned in contact with the spring housing.

9. The fastening device of claim 1 further comprising a lever positioned between the manually operated handle and the plunger, the lever including a first end including at least one latch arm and a second end positioned to act on the plunger, wherein the manually operable latch pivots on an axis and is comprised of a latch pin and the latch arm is adapted to releasably engage the latch pin when the manually operated handle is depressed and release from the latch pin when the manually operated latch is activated.

10. The fastening device of claim 9 wherein the second end of the lever acts indirectly to impart movement of the plunger.

11. The fastening device of claim 1 wherein the safety lever is operatively connected to the manually operable handle, and wherein the safety lever is configured to be depressed by the manually operable handle.

12. A fastening device comprising:

a housing;

a handle assembly including a manually operable handle portion, the manually operable handle portion adapted to be moved between a released position and a depressed position, a lever arm having a first end, a second end, and a body portion, the first end of the lever arm in contact with the handle assembly, a plunger for ejecting fasteners from the fastening device, the second end of the lever arm adapted to move the plunger, a spring adapted to control movement of the plunger wherein the spring is operable between a decompressed state when the manually operable handle portion is in the released position and a compressed state when the manually operable handle portion is in the depressed position, a manually operable latch protruding from the housing and operably mounted on said housing apart from the manually operable handle portion, wherein said manually operable latch is configured for retaining and releasing the plunger wherein the manually operable latch retains the plunger when the spring is in the compressed state and wherein the manually operable latch releases the plunger upon direct actuation of the manually operable latch by a user to cause a fastener to be ejected from said fastening device, and a safety lever have a first end and a second end, the first end of the safety lever operatively attached to the handle assembly wherein the safety lever prevents the manually operable latch from actuating when the manually operable handle portion is in the released position and wherein the safety lever allows the manually operable latch to actuate when the manually operable handle portion is in the depressed position.

13. The fastening device of claim 12 wherein the fastening device is a manually operated stapler.

14. The fastening device of claim 12 wherein the safety lever is adapted to rotate about an axis.

15. The fastening device of claim 14 wherein the safety lever is spring-biased in a counter clock-wise direction.

16. The fastening device of claim 12 wherein the lever arm rotates about a lever arm axis.

17. The fastening device of claim 12 wherein the lever arm is spring-biased in a counter clock-wise direction against the handle assembly.

18. The fastening device of claim 12 wherein the handle assembly includes a roller.

19. The fastening device of claim 12 wherein the second end of the lever arm includes a slider member wherein the slider member has an engagement end and a second end.

20. The fastening device of claim 12 wherein the fastening device is a forward acting stapler.

21. The fastening device of claim 12 wherein the fastening device is a rearward acting stapler.

22. A method for ejecting a fastener from a fastening device comprising the steps of:

providing a handle assembly including a manually operable handle portion, a lever arm having a first end, a second end, and a body portion, a plunger, a spring operable between a decompressed state and a compressed state, a manually operable latch, and a safety lever, wherein the safety lever prevents the manually operable latch from actuating when the manually operable handle portion is in a released position and wherein the safety lever allows the manually operable latch to actuate when the manually operable handle portion is in a depressed position, depressing the manually operable handle portion from the released position to the depressed position, rotating the lever arm about a pivot, moving the plunger toward the manually operable latch upon rotation of the lever arm, compressing the spring upon rotation of the lever arm, retaining the plunger with the manually operable latch when the spring is in the compressed state thereby storing energy generated from compression of the spring, again depressing the manually operable handle in order to move the safety lever to a position that allows for the actuation of the manually operable latch while retaining the plunger on the manually operable latch, actuating the manually operable latch, releasing the plunger from the manually operable latch, de-compressing the spring, moving the plunger away from the manually operable latch, and ejecting the fastener from the fastening device.

* * * * *